US006168486B1

(12) United States Patent
Lin

(10) Patent No.: US 6,168,486 B1
(45) Date of Patent: Jan. 2, 2001

(54) FLOATING BOARD

(76) Inventor: Yao Chen Lin, No.2-11, Tzeng Jia Rd., Tzeng Jia Village, Shen Kang Chang Hua 50903 (TW)

( * ) Notice: Under 35 U.S.C. 154(b), the term of this patent shall be extended for 0 days.

(21) Appl. No.: 09/366,778

(22) Filed: Aug. 4, 1999

(51) Int. Cl.[7] ..... B63B 35/83
(52) U.S. Cl. ..... 441/76; 441/65; 441/129
(58) Field of Search ..... 441/65, 66, 67, 441/68, 70, 73, 74, 75, 76, 129

(56) References Cited

U.S. PATENT DOCUMENTS 1,768,395 * 6/1930 Brylka ..... 441/76
2,651,790 * 9/1953 Geiger ..... 441/76
5,607,331 * 3/1997 Lekhtman ..... 441/76

* cited by examiner

*Primary Examiner*—Stephen Avila
(74) *Attorney, Agent, or Firm*—Dougherty & Troxell

(57) ABSTRACT

A float board includes a main board and plural subordinate boards both made of a floatable material. The main board has plural through holes of the same shape and size as the subordinate boards so that the subordinate boards may fit completely in the through holes of the main board. The subordinate boards have a wearing band bound on an upper surface for a user's feet to wear for walking on beach sand. The main board may be used to float on water, with or without the subordinate boards.

5 Claims, 4 Drawing Sheets

FLOATING BOARD

BACKGROUND OF THE INVENTION

This invention relates to a float board, particularly to one having a main board and subordinate boards possible to be assembled together or disassembled from each other so that the main board with or without the subordinate boards may be used as a float board on water, and the subordinate boards as slippers to walk on hot sand.

Conventional float boards made of foam plastic material are much safer to use than inflated annular tubes without need of inflation, but it is used only for floating on water. Swimming in the sea is prevalent in summer, and beach sand may be very hot in summer to walk on.

SUMMARY OF THE INVENTION

This invention has been devised to offer a float board consisting of a main board and plural subordinate boards separable from or combinable with the main board, with the subordinate boards usable slippers for a user to wear for walking on hot sand or swimming palms to wear in swimming.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
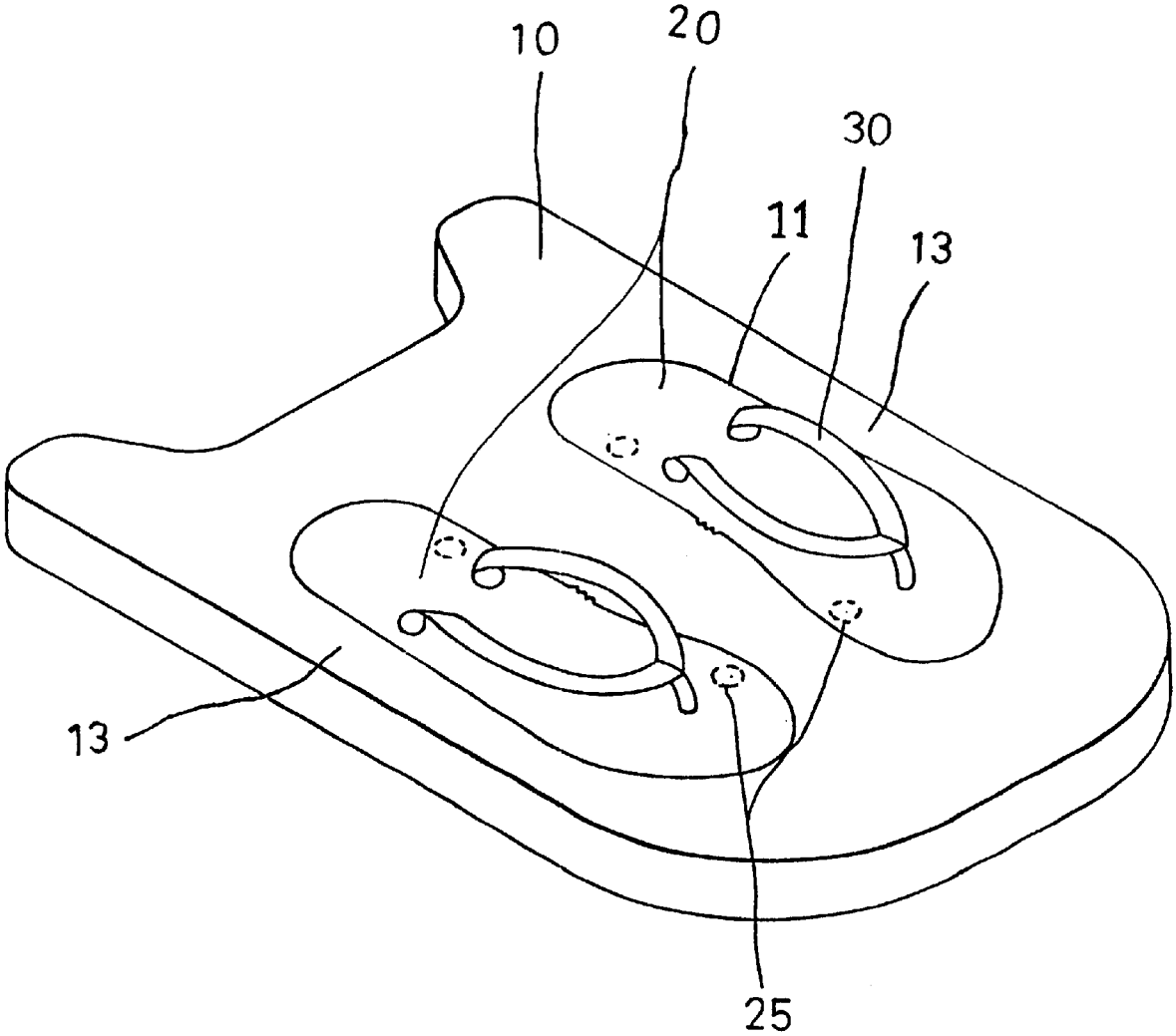
FIG. 1 is a perspective view of a floating board in the present invention.
Figure 2:
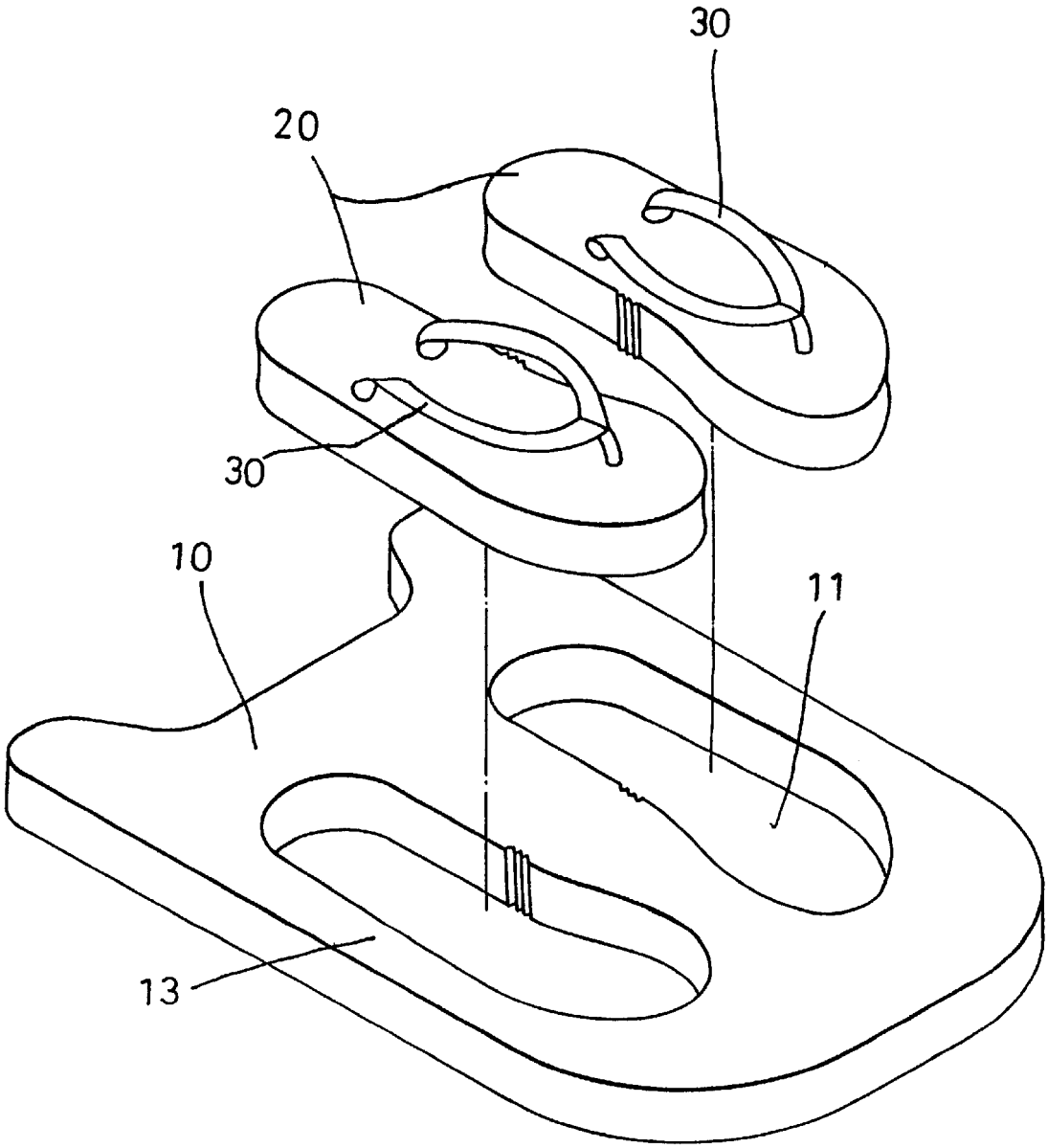
FIG. 2 is an exploded perspective view of the floating board in the present invention.
Figure 3:
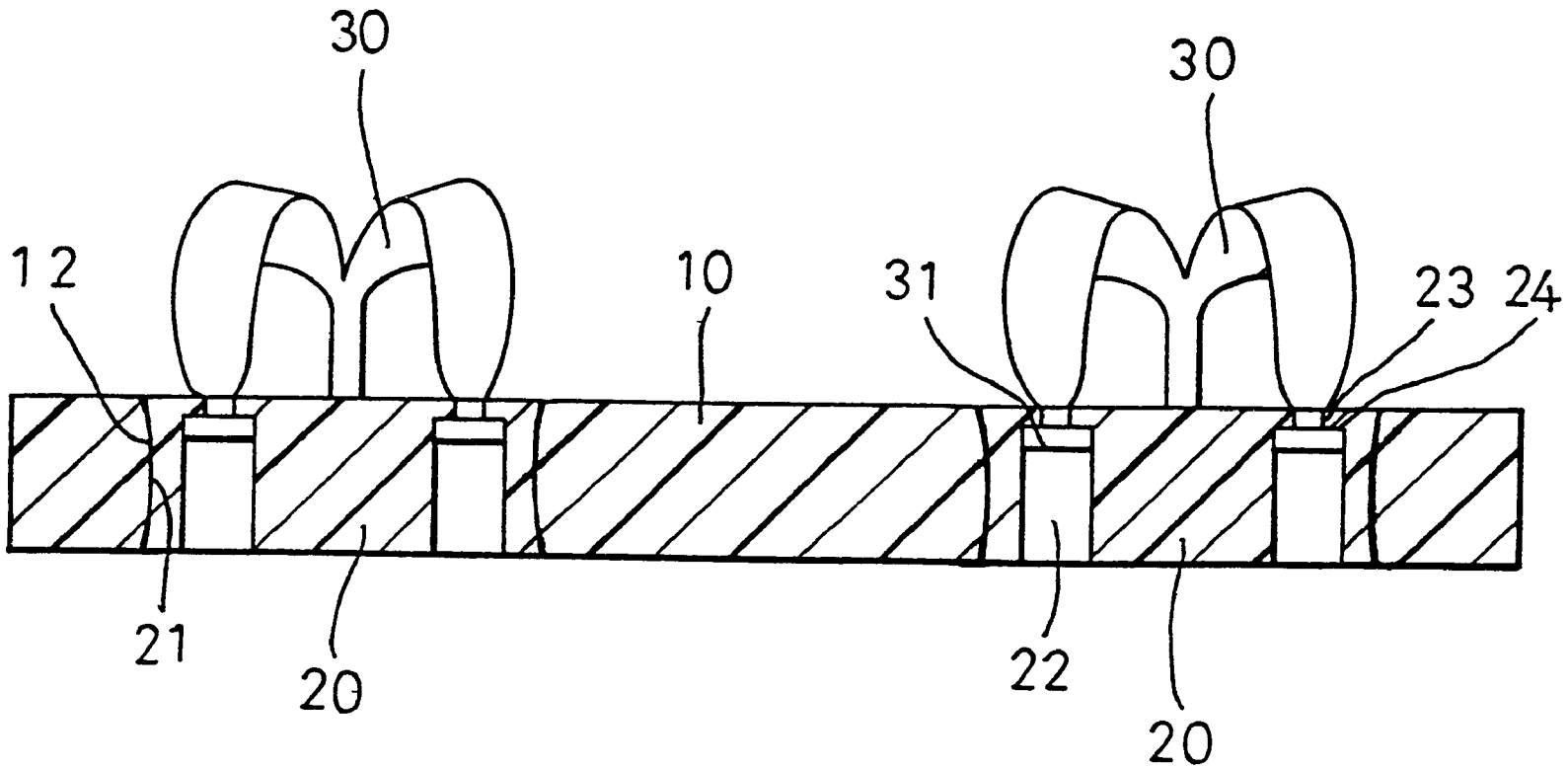
FIG. 3 is a cross-sectional view of the floating board in the present invention; and, FIG. 4 is a perspective view of the floating board being in use in the present invention.
Figure 4:
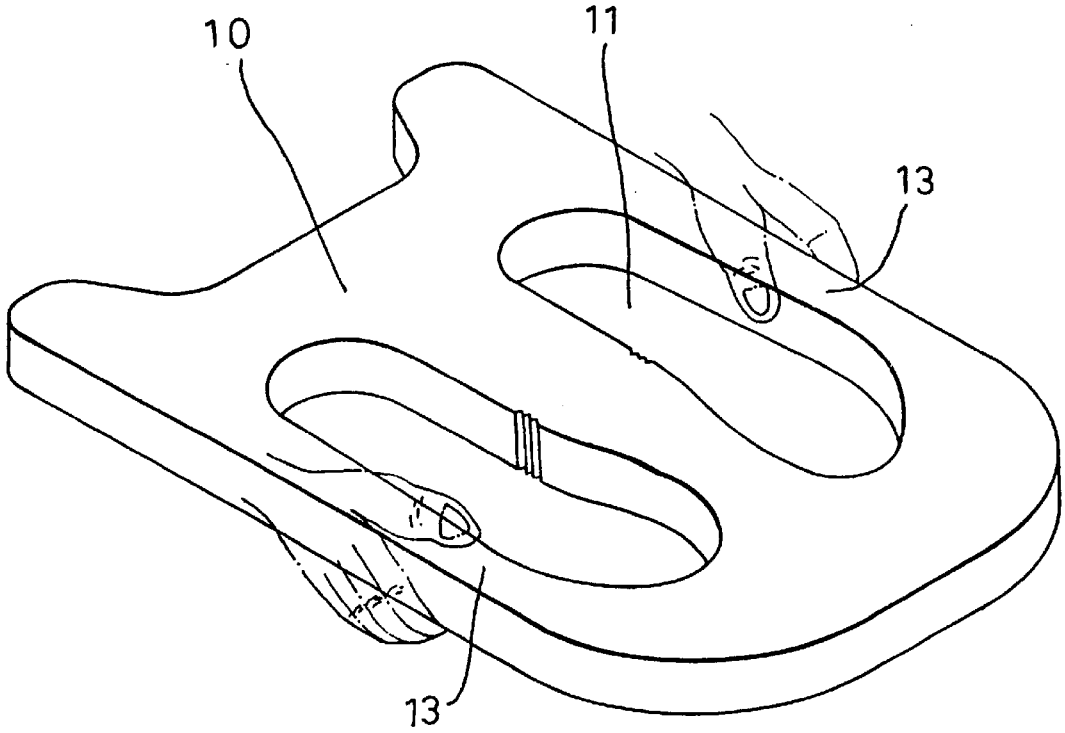

A preferred embodiment of a floating board in the present invention, as shown in FIGS. 1, 2 and 3, includes a main board 10, plural subordinate boards 20 combinable with and separable from the main board 1 as components.

The float board 10 is made of a foam material capable of floating on water, usable as a surfing board and a float board, having plural through holes 11 of a slipper shape properly spaced apart in this embodiment. However, the through holes 11 may be shaped as a palm for a hand to hold for swimming or other proper shapes. Each through hole 11 has plural convex surfaces on an inner circumferential wall.

The subordinate boards 20 are also made of a float material, having the same shape and size as the through holes 11 of the main board 1, and plural concave surfaces 21 in an outer circumferential wall corresponding to the convex surfaces 12 of the through holes 11 of the main board 10 so that the subordinate boards 20 may be placed in the through holes 12 completely when not used. Further, plural fixing holes 22 are formed in each subordinate boards 20 for a band to extend through to bind the subordinate boards 20 to the main board 10 when the former are placed in the latter.

A wearing band 30 of Y-shape is fixed on the subordinate boards 20, with ends 31 fixed in the fixing holes 22, which have a small hole 23 formed in an upper part of each fixing hole 22 for each end 31 of the wearing band 30 to flexibly squeezed through and stopped by a bottom face 24 of the small hole 23.

How to use the float board in the invention is to be described below. As shown in FIG. 2, the subordinate boards 20 may be separated from the main board 10, usable as a pair of slippers to walk on hot beach sand with the wearing band 30 hung on a foot. Thus, user's feet may be avoided from being scalded by very hot sand in summer, and in addition, the float board 10 may be held with hands inserting in the through holes 11 and holding side portions 13 defining the through holes 11, with the weight of the float board 10 reduced as well.

Next, as shown in FIG. 3, if a person wants to swim in the sea with the float board 10, then the subordinate boards 20 are inserted in the through holes 11, with the convex surfaces 12 of the through holes fitting tightly with the concave surfaces 21 of the subordinate boards 20 to secure the subordinate boards 20 with the float board 10, permitting the float board 10 float on water for the user not to sink under water.

In order to tightly combining the subordinate boards 20 with the float board 10 having a comparative thickness, the float board 10 has the convex surfaces formed in the inner wall of the through holes 11 and the subordinate slippers 20 have the concave surfaces 21 formed in its outer circumferential wall so as to let the convex surfaces 12 tightly fit the concave surfaces 21, preventing the subordinate boards 20 from falling off the float board 10 easily. Therefore, the float board 10 with the subordinate boards 20 fitting in the float board 10 may be used as a general float board.

If the subordinate boards 20 are wanted to be secured more stabilized with the float board 10, small holes 25 are additionally provided properly in the subordinate boards 20 and a band is used to bind through the small holes 25 to secure the subordinate boards 20 with the float board 10.

Further, the float board 10 without the subordinate boards 20 may also be used as a general float board, with its buoyancy reduced for training learners in swimming, and with the side portions 13 serving for grasping.

By the way, the wearing band 30 may be a lateral band as the same as common slippers instead of the Y-shape. If the through holes 11 and the subordinate boards 20 are shaped as a palm, then the wearing band 30 may be shaped as a ring instead of the Y-shape for fingers or a hand to pass through to hold them.

While the preferred embodiment of the invention has been described above, it will be recognized and understood that various modifications may be made therein and the appended claims are intended to cover all such modifications which may fall within the spirit and scope of the invention.

What is claimed is:

1. A float board comprising:

a main board made of a material floatable on water, having two spaced apart through holes in an intermediate portion, wherein said through holes of said main board respectively have convex surfaces on an inner circumferential wall; and, two subordinate boards made of a floatable material, having the same shape and size as said through holes of said main board and respectively a wearing band bound on an upper surface of each said subordinate boards, said subordinate boards being removably inserted in said two through holes of said main board, said subordinate boards respectively having concave surfaces on an outer circumferential wall, and said convex surfaces fitting tightly with said concave surfaces when said subordinate boards are inserted in said through holes of said main board.

2. The float board as claimed in claim 1, wherein said subordinate boards and said through holes of said main board are shaped as a slipper.

3. The float board as claimed in claim 1, wherein said wearing band comprises a Y-shaped band.

4. The float board as claimed in claim 1, wherein said through holes of said main board and said subbordiate boards are shaped as a palm.

5. The float board as claimed in claim 1, wherein said wearing band comprises a plurality of annular bands.

* * * * *